US005785102A

United States Patent [19]

Hamel

[11] Patent Number: 5,785,102

[45] Date of Patent: Jul. 28, 1998

[54] BOARD EDGING INFEED APPARATUS

[75] Inventor: Gérald Hamel, St-Éphrem, Canada

[73] Assignee: Industries P.H.L. Inc., St-Ephrem, Canada

[21] Appl. No.: 800,990

[22] Filed: Feb. 20, 1997

[51] Int. Cl.[6] ..... B27B 1/00

[52] U.S. Cl. ..... 144/387; 83/76.8; 83/364; 83/367; 144/242.1; 144/248.3; 144/250.23; 144/357; 144/389; 144/378; 144/245.2; 144/248.4; 198/434; 198/624

[58] Field of Search ..... 144/242.1, 245.1, 144/246.1, 245.2, 250.17, 250.21, 250.23, 250.25, 356, 357, 376, 377, 378, 382, 387, 389; 198/341, 345.1, 434, 457, 468.1, 394, 572, 624; 83/76.8, 365, 367, 364, 368, 370

[56] References Cited

U.S. PATENT DOCUMENTS

| | | | |
|---|---|---|---|
| 1,853,773 | 4/1932 | McDonough . | |
| 3,084,726 | 4/1963 | Dennison . | |
| 3,736,968 | 6/1973 | Mason . | |
| 3,963,938 | 6/1976 | Sanglert . | |
| 3,983,403 | 9/1976 | Dahlström et al. . | |
| 4,086,496 | 4/1978 | Berry . | |
| 4,240,477 | 12/1980 | Horn et al. . | |
| 4,269,245 | 5/1981 | Fornell et al. . | |
| 4,340,137 | 7/1982 | Foster . | |
| 4,383,561 | 5/1983 | Gregoire et al. . | |
| 4,413,662 | 11/1983 | Gregoire, et al. | 144/248.4 |
| 4,468,992 | 9/1984 | McGeehee . | |
| 4,471,823 | 9/1984 | Wadell . | |
| 4,546,440 | 10/1985 | Palmberg . | |
| 4,823,851 | 4/1989 | Seffens | 144/248.4 |
| 4,949,769 | 8/1990 | Camenon | 144/250.23 |
| 4,977,805 | 12/1990 | Corley, III . | |
| 5,099,896 | 3/1992 | Ritola . | |
| 5,115,846 | 5/1992 | Miller et al. . | |
| 5,368,080 | 11/1994 | Hamel . | |

*Primary Examiner*—W. Donald Bray
*Attorney, Agent, or Firm*—Dvorak & Orum

[57] ABSTRACT

Disclosed herein is an apparatus for positioning an elongate cant for the infeed of the cant into an edging device capable of longitudinally cutting the cant to remove the wane edges thereof. The apparatus generally comprises: a frame structure; a conveying module for transversely conveying the cant along a substantially straight path; a scanning module located along the path for optically scanning the morphology of the cant and providing morphology data; a computer module linked to the scanning means for analyzing the morphology data and calculating a longitudinal preferred infeed line for said cant; and a positioning means located further along the path for transversely positioning the cant to a colinear relationship with the preferred infeed line for said cant. More specifically, the positioning means comprises a plurality of spaced apart, releasable, pinching members. The pinching members are connected to lifting and opening means to cause sequential lifting of pinching members above incoming cants, lowering of pinching members onto the cants, pinching of the cants and positioning of the pinched cants. Once positioned the cants are fed longitudinally along the preferred infeed line into the edging device.

5 Claims, 9 Drawing Sheets

44
46
46
38
58
68
56
46
46
52
28
40'
40

BOARD EDGING INFEED APPARATUS

BACKGROUND OF THE INVENTION

1. Field of Invention

This invention relates to sawmill equipment and more specifically to an apparatus for positioning boards to be fed through board edging saws to expose maximum usable dimensioned lumber therefrom. In greater particularity, the present invention relates to a high speed infeed system.

2. The Prior Art

The boards handled by the infeed system are sawn cants. Cants are commonly described as planks of portions of logs after longitudinal ripsawing. They generally have flat top and bottom horizontal surfaces and unfinished and irregular longitudinal sides surfaces, called wane edges, which may still have bark. To produce dimensioned lumber, wane edges required to be eliminated. Conventionally an edging saw assembly will comprise at least two circular saws removing the wane edges of the board. Throughout this description, the words "board" and "cant" will be used interchangeably.

Numerous computer controlled systems have been developed to optimize the trimming of wane edges of boards to produce dimensioned lumber while minimizing waste. Optimization is obtained, for example, by using optical scanners which relay data on the specific morphology of a board to a computer which receives and analyses the data to control the board edge trimming process. The optical scanning method consists of transversely moving a board across light beams located at various points along the length of the board such that the light beam is interrupted and the restored as the board passes. The resultant measurement data is then fed to a computer which will compute a prescribed edging cut to maximize the production of useful dimensioned lumber. The computer will then control equipment which will effect such a preferred cut. Various examples of such systems are disclosed in the Sanglert U.S. Pat. No. 3,963,938 issued Jun. 15, 1976, in the Berry U.S. Pat. No. 4,086,496 issued Apr. 25, 1978, in the McGeehee U.S. Pat. No. 4,468,992 issued Sep. 4, 1984, and in the Wadell U.S. Pat. No. 4,471,823 issued Sep. 18, 1984.

With optical scanning systems, optimization of the edge trimming process is achieved in either of two ways. According to a first method, the edge trimming saws can be laterally adjustable relative to a constant edging path followed by every board as shown for example, by Sanglert U.S. Pat. No. 3,886,372. However, such methods require the replacement, at a great expense, of existing non-laterally adjustable board edging saw equipment with new computer controlled laterally adjustable board edging equipment. Consequently, such methods have failed to gain recognition and have failed in replacing conventional equipment.

In another method, optimization is achieved with conventional fixed position edge saws but the boards are precisely aligned on an preferred edging path determined by the computer and based on the optical scanning data. This permits computer controlled cutting optimization systems to be used with existing fixed position board edging equipment (Horn et al. U.S. Pat. No. 4,240,477). More particularly, Horn et al. disclose a computer controlled alignment system using a movable mounting frame. Boards are laid on the mounting frame which is displaced, transversely to the edging path, to a final position which is computed to align the board with a preferred edging path and allow the board to be propelled by spiked feed rollers along the preferred edging path. The mounting frame slides on ball bearings on beams which are themselves bolted to the floor of the mill.

Such systems have the inherent and severe drawback that they fail to be operable at the high processing speeds required in modern and efficient milling operations. To be more explicit, in the system disclosed by Horn et al, the mounting frame is moved by hydraulic cylinders. In addition, shock dampers are provided at each extremity of the range of movement of the mounting frame. In use, the mounting frame will slam against the hydraulic shock dampers and the momentum carried by the mounting frame will be transmitted to the support structure holding the hydraulic shock dampers and finally to the mill floor. If the system is accelerated, the slamming effect will in all probability increase to a point where the lumber resting on the mounting frame will skid on it and lose its alignment along the preferred edging path. This is specially true when slippery wet or frozen boards are being processed. More importantly, the entire assembly will become subjected to important structural shocks and will be prone to breakdowns.

The prior art also provides movable clamping devices for clamping and positioning boards from below. However, these devices have the important disadvantage of having high maintenance requirements because the longitudinal feeding chains used to propel boards into the edging saws have to follow a complicated path around and below each clamping device.

Another example is U.S. Pat. No. 5,368,080 to Hamel, also assigned to the present assignee, discloses a board positioning system using an eccentric arm assembly to quickly position a board by clamping it and moving it from below. Although such system is adequate in most situations, warped boards will often not be properly positioned the system components will be subject to strict maintenance requirements.

Thus the need exists for board infeed equipment which can smoothly and quickly position a board (even a warped board) along a preferred edging path while being operable in conjunction with a conventional optical scanning system and conventional fixed woodworking equipment such as a fixed position edging device.

SUMMARY OF THE INVENTION

Generally speaking, the invention provides an apparatus for positioning an elongate cant for the infeed of the cant into an edging device capable of longitudinally cutting the cant to remove the wane edges thereof, said apparatus comprising:

a frame structure;

a conveying module for transversely conveying the cant along a substantially straight path;

a scanning module located along the path for optically scanning the morphology of the cant and providing morphology data;

a computer module linked to the scanning means for analyzing the morphology data and calculating a longitudinal preferred infeed line for said cant;

positioning means located further along the path for transversely positioning the cant to a colinear relationship with the preferred infeed line for said cant;

the positioning means comprising a plurality of spaced apart, releasable, pinching members, said pinching members being connected to lifting and opening means to cause sequential lifting of pinching members above incoming cants, lowering of pinching members onto the cants, pinching of the cants and positioning of the pinched cants;

feeding means for longitudinally advancing the cant along the preferred infeed line into the edging device;

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DETAILED DESCRIPTION OF THE PREFERRED EMBODIMENT

Before describing the present invention in detail, it is to be understood that the invention is not limited in its application to the details of construction and parts illustrated in the accompanying drawings and described herein. The invention is capable of other embodiments and of being practiced in various ways. It is also to be understood that the phraseology or terminology used herein is for the purpose of description and not limitation.

Figure 1:
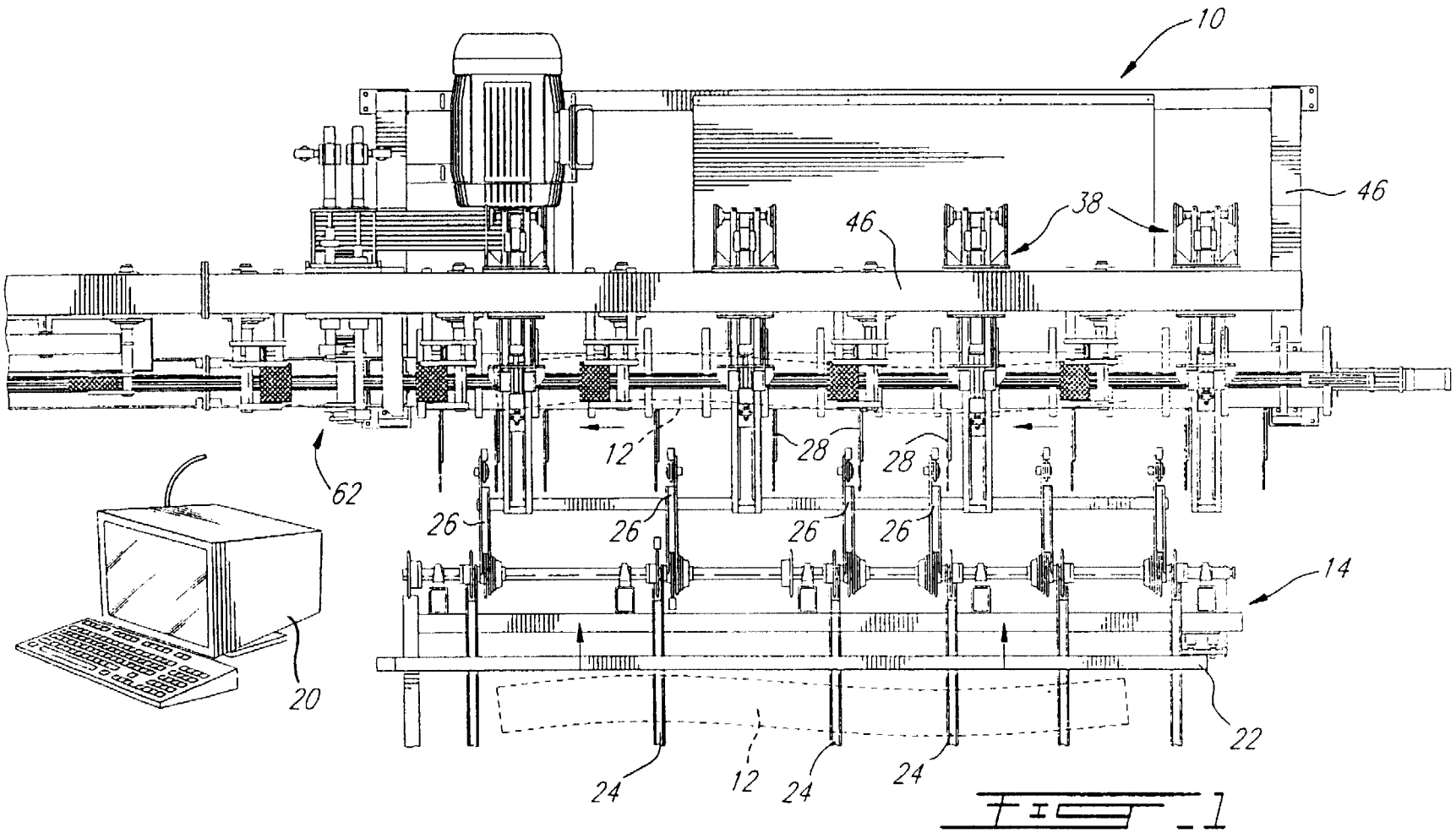
FIG. 1 is a top view of the board edging apparatus of the present invention, for illustration purposes the apparatus being shown next to a conventional transverse board conveyor.

Now referring to the drawings, more specifically to FIG. 1, the present invention comprises an infeed optimization apparatus 10 capable of receiving boards 12 from transversal conveyor 14. The aim of apparatus 10 is to rapidly and smoothly align boards 12 for longitudinal feeding through edge trimming saws 16 to obtain dimensioned lumber. Apparatus 10 automatically selects a preferred feeding path for each measured board so as to expose an maximum amount of useful dimensioned lumber. The apparatus 10 will then sequentially and rapidly transports boards 12 to a position in alignment with the preferred feeding path. The apparatus 10 will then longitudinally propel the boards through the edge trimming saws 16 to produce dimensioned lumber.

Figure 2:
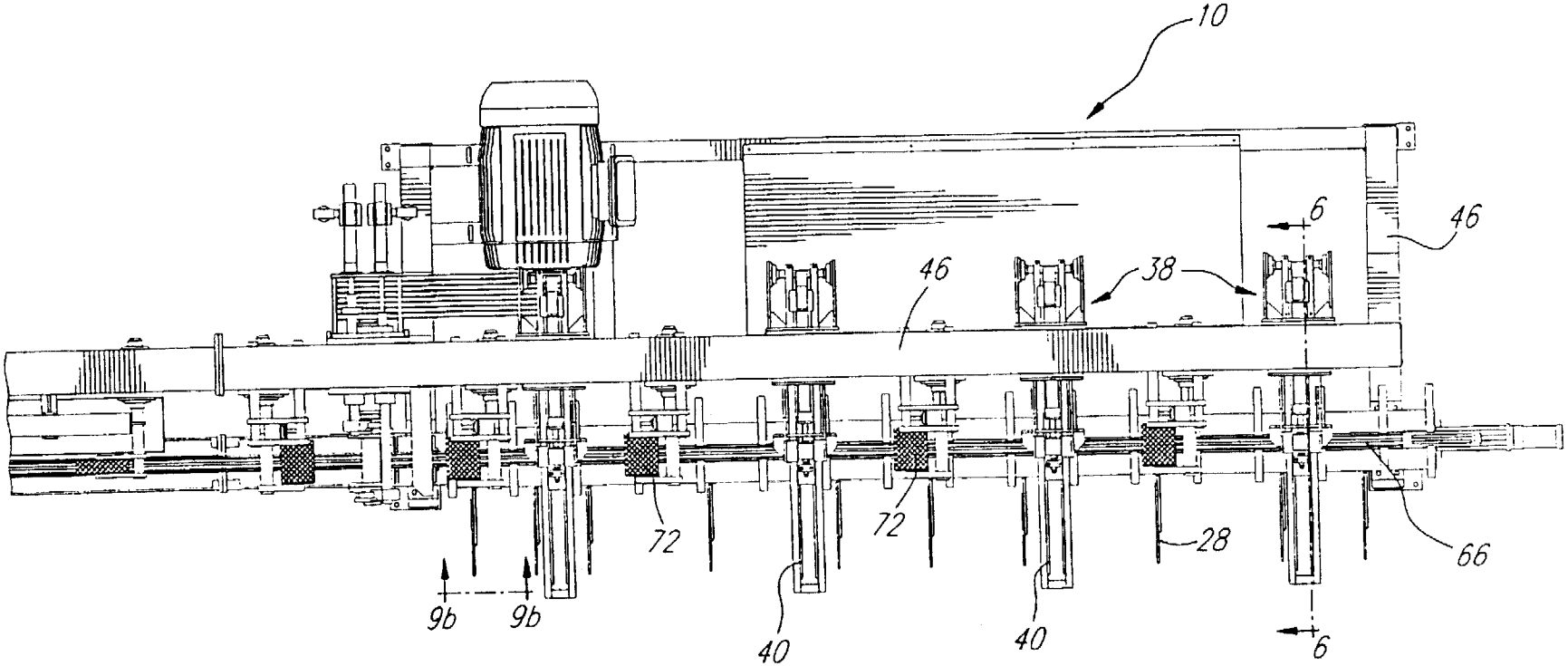
FIG. 2 is a top view of the board edging apparatus of the present invention.
Figure 10A:
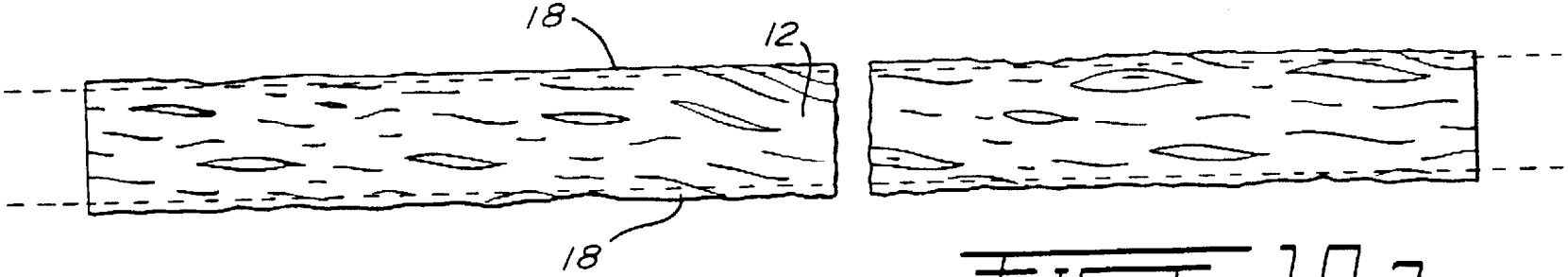
FIG. 10*a* is a top view of an non-edged board.
Figure 10B:
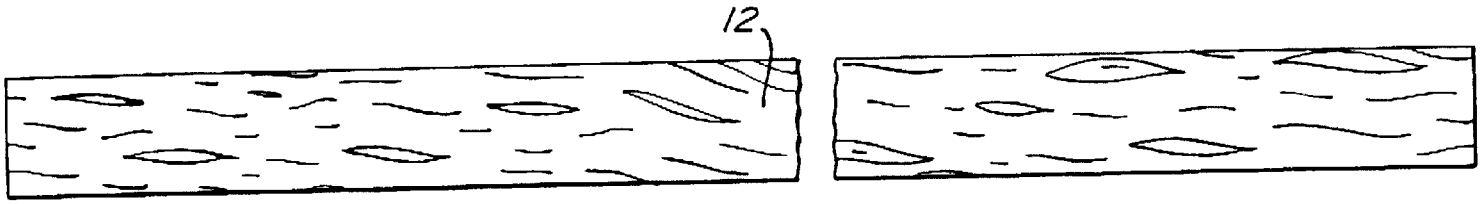
FIG. 10*b* is a top view of a board after edging.

Turning now to FIGS. 2, 10*a* and 10*b*, the boards 12 handled by apparatus 10 are cants having wane edges 18 which may still exhibit bark. These wane edges 18 require to be trimmed-off to reveal useful dimensioned lumber. The dotted lines on board 12 are representative of the preferred trimming lines as calculated by a computer 20 from optical measurement data provided by an optical scanning station 22 as shown in FIG. 1. The optical scanning station 22 may be of conventional manufacture such as an Autolog® brand scanning station. The edge trimming saws, commonly called an edger unit can be conventional and comprise a pair of circular saws held in a chosen distance from each other. Thus, to optimize the edge trimming operation, the longitudinal feeding path of boards 12 through the edger unit will be the only variable to be adjusted for optimization of the removal of wane edges 18.

Figure 4:
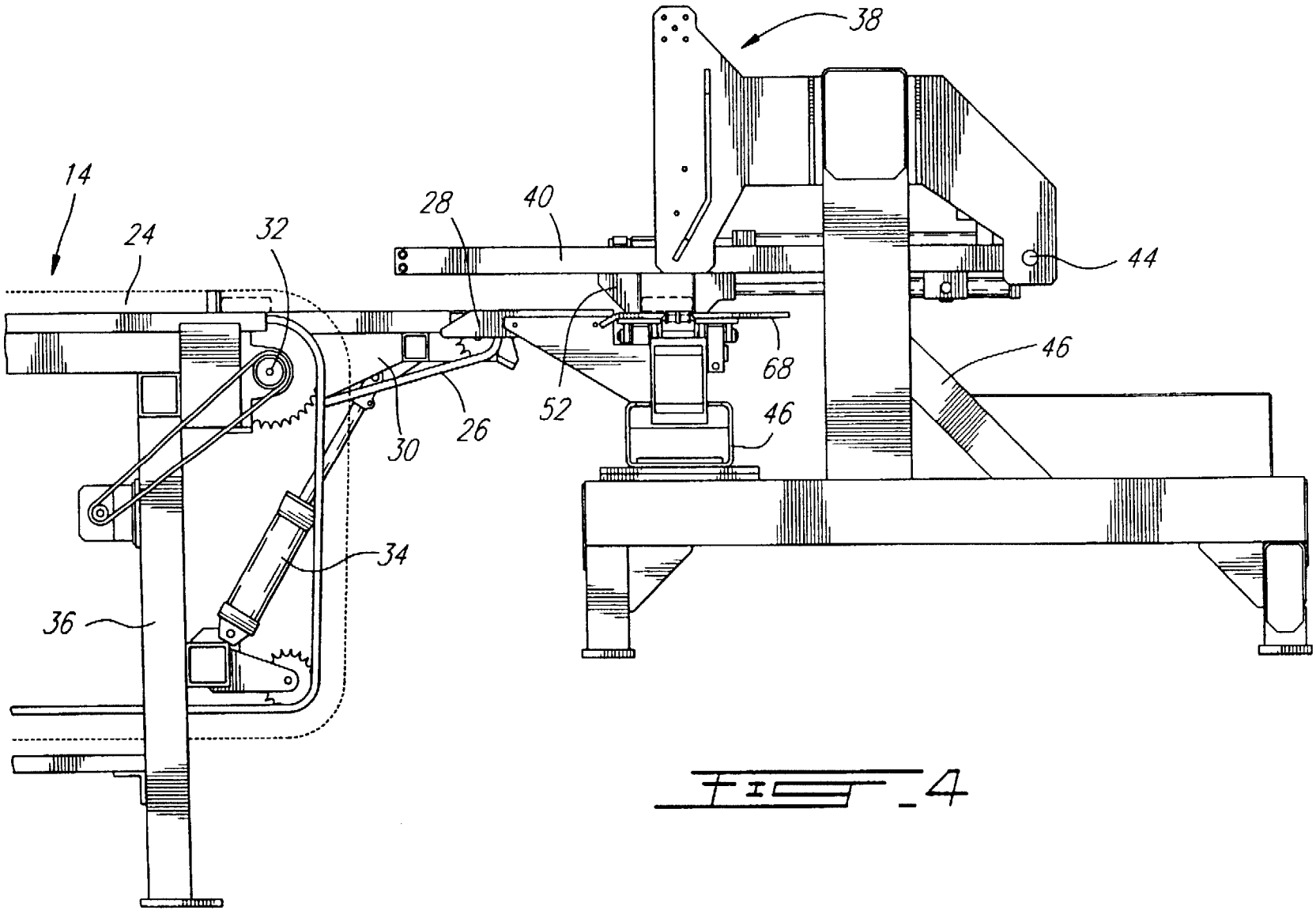
FIG. 4 is a schematic side elevational view seen from the right of the apparatus shown in FIG. 1.

Referring again to FIG.1 of the drawings, a board 12 enters apparatus 10 from transverse conveyor 14. Transverse conveyor 14 is provided with endless chains 24 for transverse movement of boards 12. As shown in FIG.4, boards transfer to apparatus via output chains 26 bridging the last distance between endless chains 24 and receiving arms 28 on apparatus 10. Output chains 26 are mounted on chain supports 30 pivotally mounted to axis 32 of transverse conveyor 14. Once the transfer of board 12 is made, output chains 26 are lowered by pivoting downward chain supports 30. This is accomplished by retracting hydraulic cylinder 34 mounted to frame 36.

In one aspect, the invention particularly relates to the apparatus for the transversal positioning of boards 12 prior to their being propelled longitudinally through the edge trimming saws 16. Referring still to FIG. 4, the aspect of the invention consists of a sliding pinch finger apparatus generally designated by arrow 38. This is shown in greater detail on FIGS. 5 and 6, to which reference is now made. As shown in dotted lines, sliding pinch finger 40 can be raised at position 40' by hydraulic cylinder 42 pivoting on pivot shaft 44, the latter two being mounted to frame structure 46.

Figure 6:
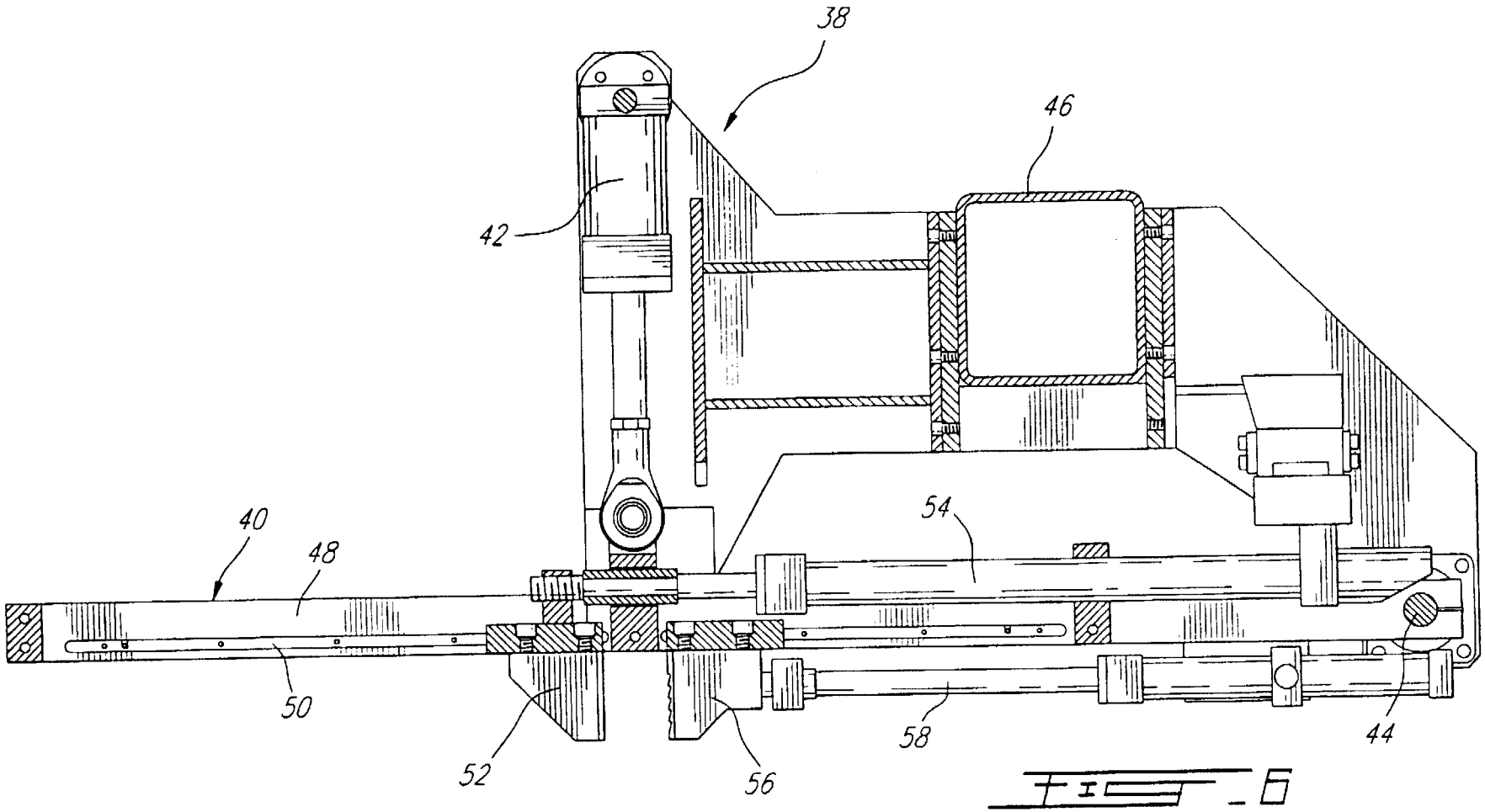
FIG. 6 is an isolated cross-sectional side elevation view taken along line 6—6 of FIG. 2.

As shown in FIG. 6, sliding pinch finger 40 comprises a slide guide 48 provided with brass key 50. The pinching mechanism is composed of a top jaw 52 sliding on slide guide 48 and brass key 50. The sliding movement of top jaw 52 is precisely controlled by linear positioning cylinder 54. Bottom jaw 56 is also slidable on slide guide 48 and brass key 50. Bottom jaw 56 is connected to a damping air cylinder 58. Linear positioning cylinder is preferably a servo positioner cylinder of commercially available manufacture such as a LinearLogic® brand cylinder.

Figure 5:
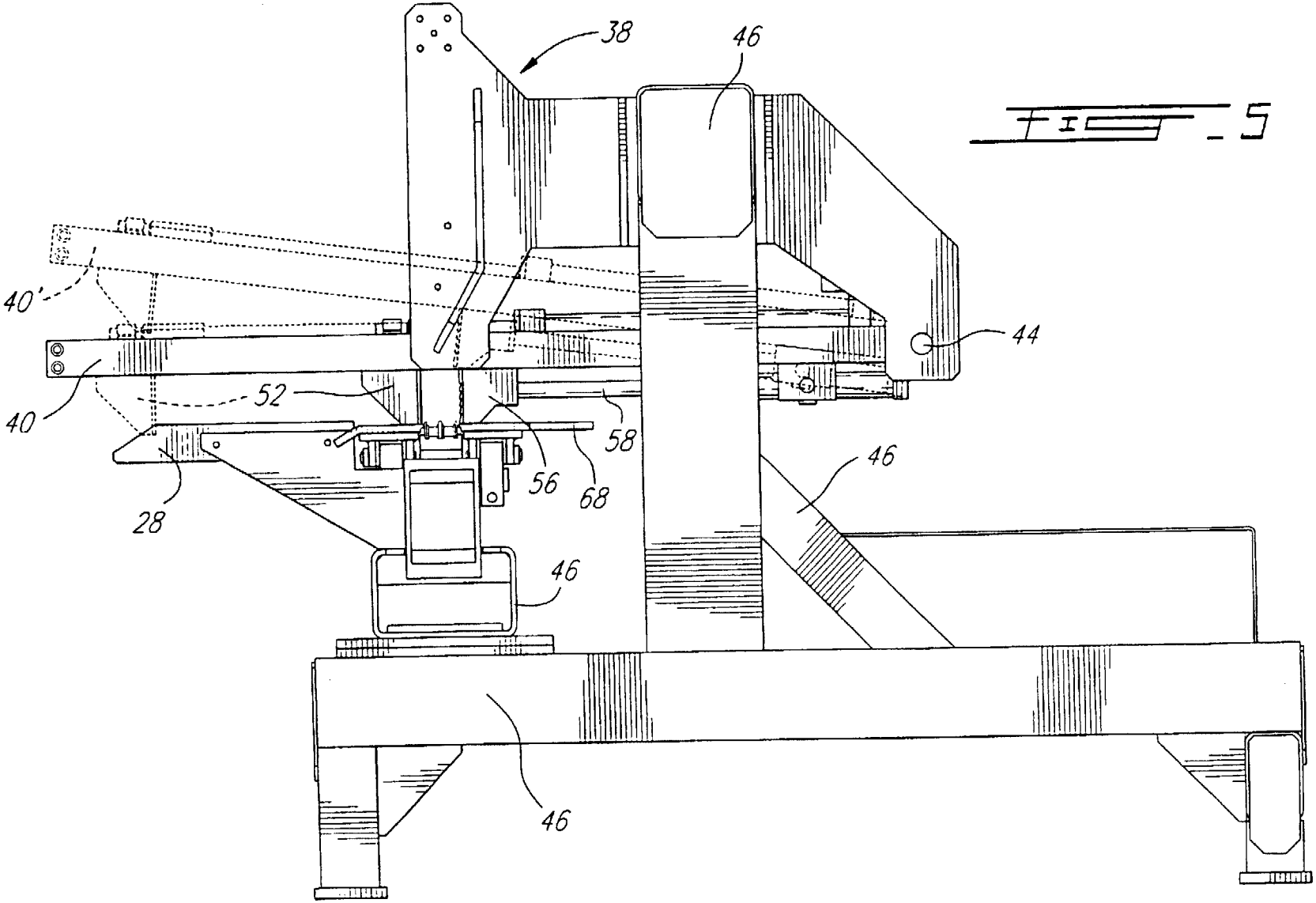
FIG. 5 is a schematic side elevational view seen from the right of the apparatus shown in FIG. 2.

In operation, boards 12 are transversely and sequentially slid onto receiving arms 28 while sliding pinch finger 40' is raised as shown in dotted lines on FIG. 5. Once a board 12 is on receiving arms 28, sliding pinch finger 40 is lowered towards board 12 so as to be generally parallel to receiving arms 28 and with top jaw 52 in the open position, i.e. with the linear positioning cylinder 54 it its full course extension. If a board 12 is excessively warped in the Z axis, this curvature is controlled by the clearance between the slide guide 48 and receiving arms 28. In a most preferred embodiment, this clearance is about 4 inches.

The positioning operation continues by a retraction of linear positioning cylinder 54 thereby closing top jaw 52 towards bottom jaw 56 and pulling in board 12. The end position of liner positioning 54 is calculated by computer 20 based on optical scanning data for the particular board being positioned. The main purpose of bottom jaw 56 is to permit board 12 to be firmly positioned between top jaw 52 and bottom jaw 56. Cylinder 58 serves as a shock absorber to maintain pressure on bottom jaw 56. Those skilled in the art will of course appreciate that computer 20 controls the sequence and pace of all these operations. Furthermore, depending on the optical data gathered from board 12, each sliding pinch finger apparatus 38 is controlled independently so as to precisely position each board 12 in the x-y place. Once in position, board 12 will be lowered onto endless dual chain 60 (not shown) running longitudinally under below board 12 and will be propelled into edging saw assembly 62 by dual chain 60 and spiked feed rollers 64. The edging saw assembly will generally consist of circular saws capable of quickly removing the wane edges from board 12.

Figure 3:
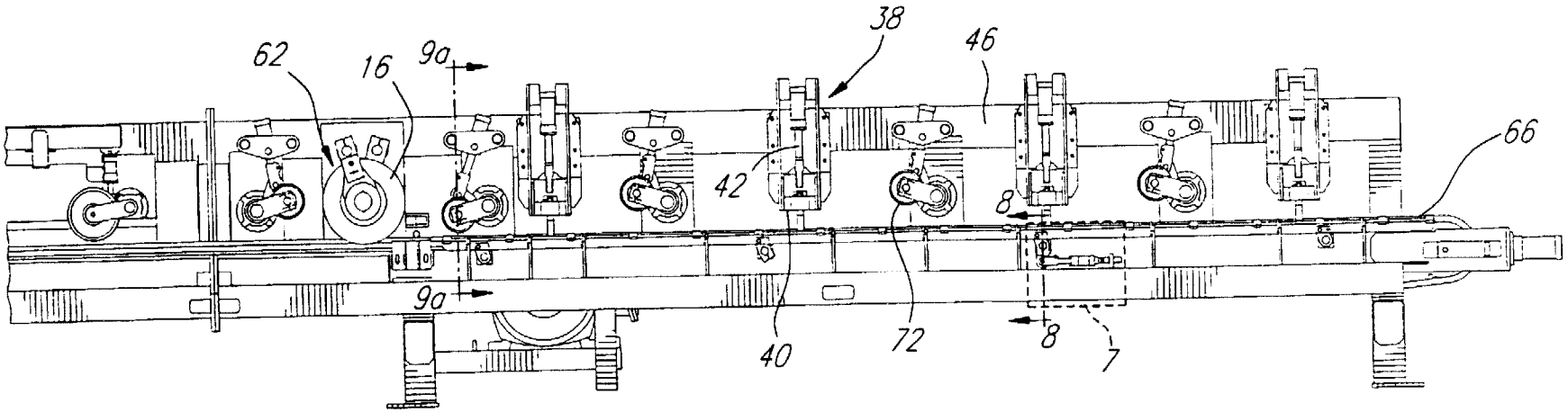
FIG. 3 is a schematic side elevational view of the board edging apparatus.
Figure 8:
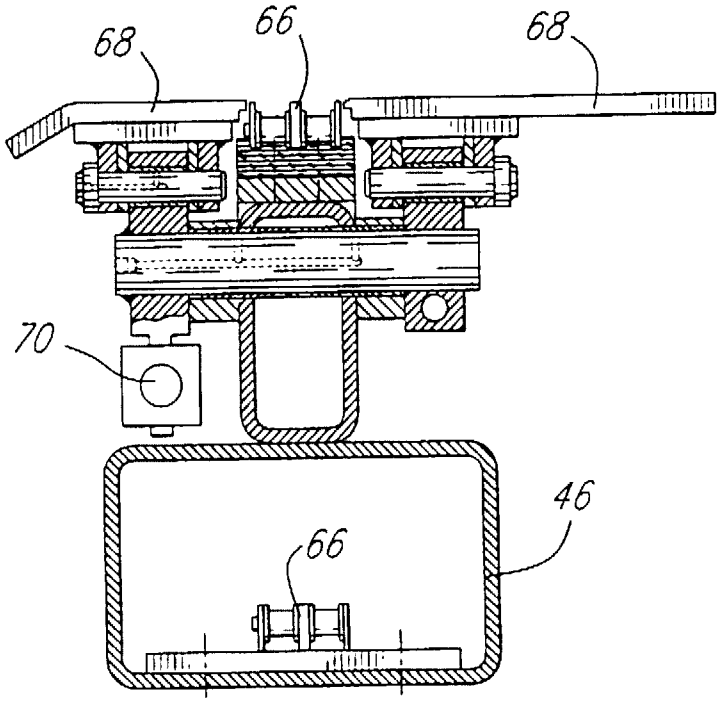
FIG. 8 is an isolated cross-sectional side elevation view taken along line 8—8 of FIG. 3.
Figure 7:
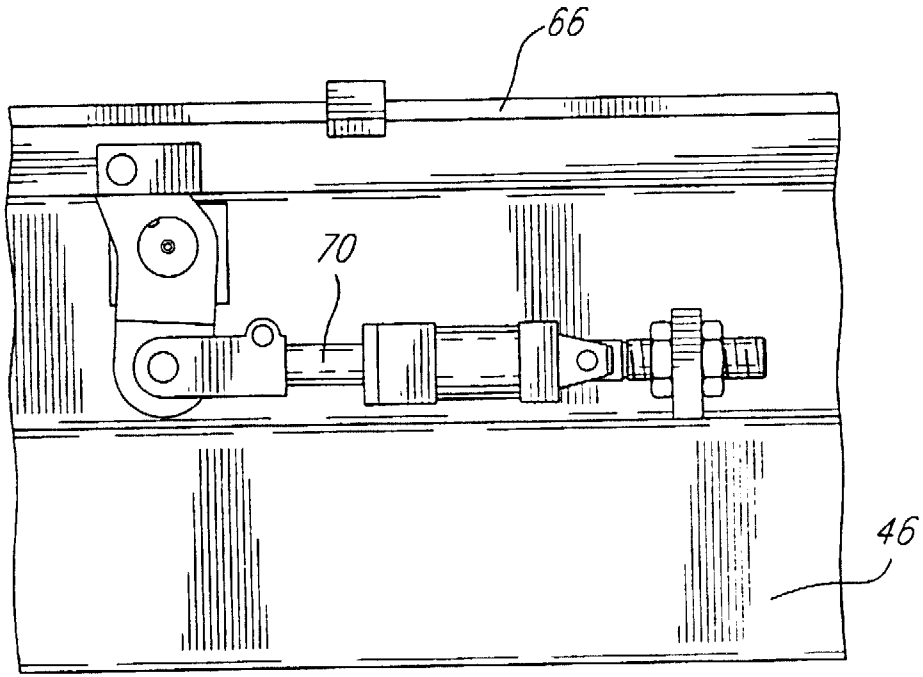
FIG. 7 is an isolated front elevational view of the hydraulic cylinder device shown on FIG. 3.
Figure 9B:
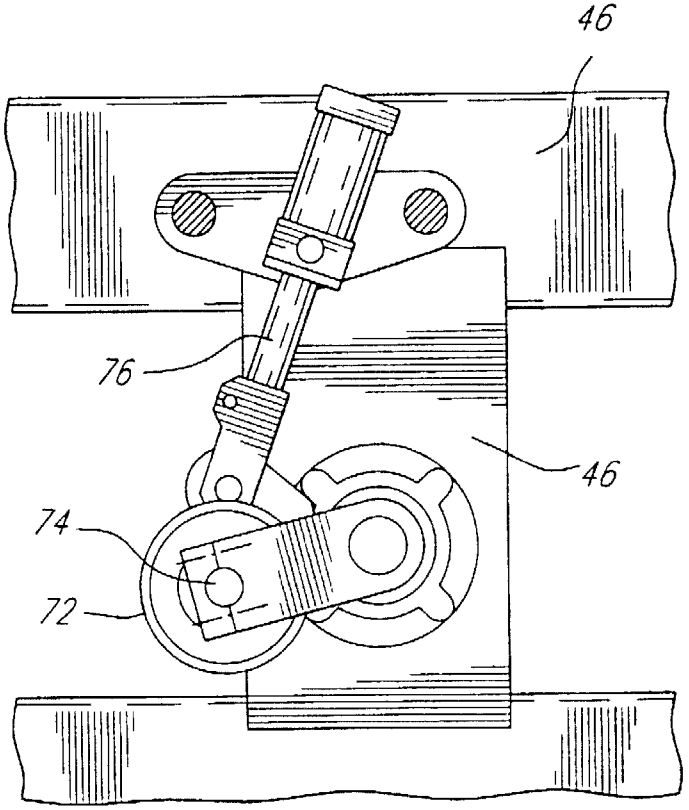
FIG. 9*b* is an isolated front elevational view of the press roller device shown on FIG. 9.
Figure 9A:
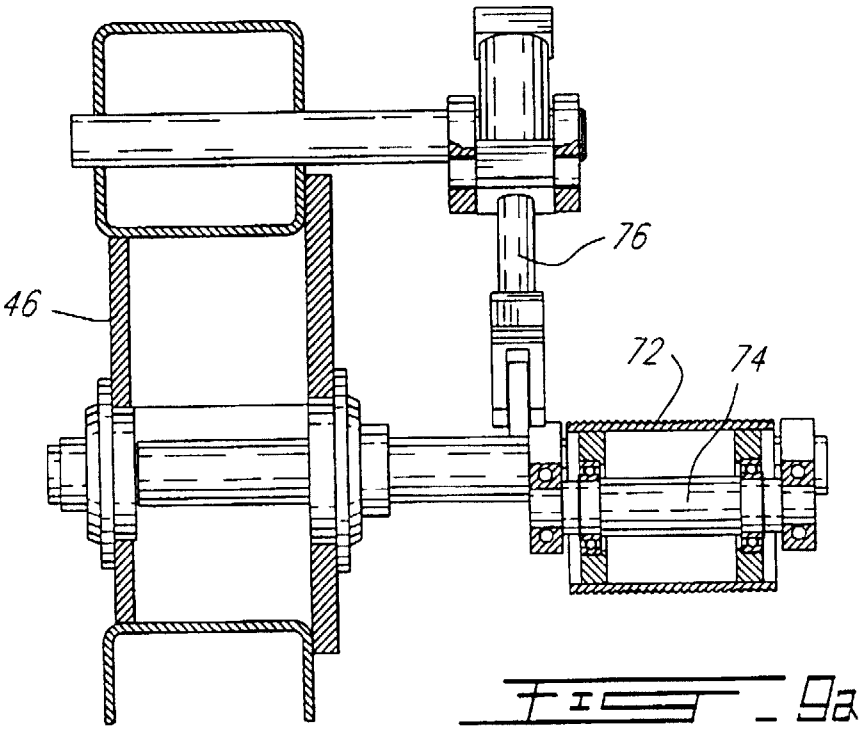
FIG. 9*a* is an isolated cross-sectional side elevation view taken along line 9—9 of FIG. 2.

Referring now to FIGS. 5, 7 and 8, the preferred method of lowering boards 12 on dual chain 60 will be described in further detail. Dual chain 60 runs on a fixed position chain track 66 mounted to frame 46. Running longitudinally and on both sides of dual chain 60 is a two part lifting table 68 mounted on hydraulic cylinders 70, in turn mounted to frame 46. When in the raised position as shown in FIG. 8, lifting table 68 is sufficiently above dual chain 60 to allow transversal sliding of boards 12 above dual chain 60. Once positioned, boards 12 are lowered onto dual chain 60 by lowering lifting table 68 under command of cylinders 70. Simultaneously or soon thereafter, spiked feed rollers 72, shown in FIGS. 3, 9*a* and 9*b*, are lowered onto boards 12 to maintain boards 12 in firm frictional engagement on dual chain 60. Each feed roller 72 can be mounted as freely rotating on shaft 74. The feed roller are lowered and raised at will by actuating cylinder 76 mounted to frame 46.

It will be readily understood that as with other parts of the inventive apparatus, the operation of lifting table 68 and spiked feed rollers 72 is under the control of computer 20. Indeed, computer 20, with proper and adapted interfaces will direct the exact sequence, pace and duration of each operation to effect a swift and smooth positioning of each board 12 for longitudinal feeding into edging saw assembly 62.

It is also to be understood that the number of sliding pinch fingers required and the distance between each one necessary to firmly and properly position boards 12 will depend on the length of boards being handled. Furthermore, although the preferred embodiment has been described in relation to hydraulic cylinder equipment, other movement generating means such as pneumatic and electric are envisaged.

Although the invention has been described above with respect with one specific form, it will be evident to a person skilled in the art that it may be modified and refined in various ways. It is therefore wished to have it understood that the present invention should not be limited in scope, except by the terms of the following claims.

I claim:

1. An apparatus for positioning an elongate cant for the infeed of the cant into an edging device capable of longitudinally cutting the cant to remove the wane edges thereof, said apparatus comprising:

a frame structure;

a conveying module for transversely conveying the cant along a substantially straight path;

a scanning module located along the path for optically scanning the morphology of the cant and providing morphology data;

a computer module linked to the scanning means for analyzing the morphology data and calculating a longitudinal preferred infeed line for said cant;

positioning means located further along the path for transversely positioning the cant to a collinear relationship with the preferred infeed line for said cant, the positioning means comprising a plurality of spaced apart, releasable, pinching members, said pinching members being connected to lifting and opening means to cause sequential lifting of pinching members above incoming cants, lowering of pinching members onto the cants, pinching of the cants and positioning of the pinched cants; and feeding means for longitudinally advancing the cant along the preferred infeed line into the edging device.

2. The apparatus of claim 1, wherein said pinching members are pinching fingers comprising movable jaws adapted to seize the cant.

3. The apparatus of claim 2, wherein saw movable jaws comprise a top jaw and a bottom jaw, both slidably mounted on a rigid slide guide.

4. The apparatus of claim 3 wherein said top jaw is operatively connected to a linear positioning cylinder so as to retract and close on said bottom jaw, said bottom jaw being operatively connected to a damping cylinder.

5. The apparatus of claim 4 wherein said rigid slide is pivotally connected to said frame structure and is operatively connected to a lifting member so as to sequentially lift and lower said rigid slide in relation to said pivotal connection so as to allow passage of said cant under said pinching members.

* * * * *